United States Patent [19]

Diaz et al.

[11] Patent Number: 4,566,961

[45] Date of Patent: Jan. 28, 1986

[54] ELECTRIC ARC CONVERSION PROCESS

[75] Inventors: Henri Diaz, Dunkerque; Pierre Jorgensen, La Haye Les Roses; Pierre Vernet, Martigues, all of France

[73] Assignee: The British Petroleum Company p.l.c., London, England

[21] Appl. No.: 668,280

[22] PCT Filed: Mar. 1, 1984

[86] PCT No.: PCT/GB84/00067

§ 371 Date: Oct. 18, 1984

§ 102(e) Date: Oct. 18, 1984

[87] PCT Pub. No.: WO84/03515

PCT Pub. Date: Sep. 13, 1984

[30] Foreign Application Priority Data

Mar. 2, 1983 [FR] France ..... 83 03424

[51] Int. Cl.[4] ..... C25C 3/24

[52] U.S. Cl. ..... 204/168; 204/170; 204/171; 204/172; 204/173; 48/65

[58] Field of Search ..... 204/168, 170, 171, 172, 204/173; 48/65

[56] References Cited

U.S. PATENT DOCUMENTS

| | | | |
|---|---|---|---|
| 3,384,467 | 5/1968 | Ammann | 204/168 |
| 3,870,611 | 3/1975 | Vestal | 204/168 |
| 4,472,172 | 9/1984 | Sheer | 204/173 |

*Primary Examiner*—John F. Niebling

*Attorney, Agent, or Firm*—Morgan, Finnegan, Pine, Foley & Lee

[57] ABSTRACT

Electric arc conversion process in which $C_1$–$C_4$ alkane is brought into contact with an electric arc and higher molecular weight carbonaceous material is brought into contact with the hot gas derived from the $C_1$–$C_4$ hydrocarbon in the vicinity of the arc.

11 Claims, 5 Drawing Figures

ELECTRIC ARC CONVERSION PROCESS

It is known to use the energy produced by an electric arc (allowing temperatures from 3000° to 10,000° K. and more to be obtained) in order to favour chemical reactions which are difficult to carry out at ordinary temperatures. French Pat. No. 1 561 404 discloses a process for cracking liquid hydrocarbons in a electric arc. This process is carried out with electrodes immersed in the liquid and requires an apparatus for rapidly rotating an electrode relative to a fixed electrode.

U.S. Pat. No. 3,384,467 discloses the conversion of coal using an electric arc furnace. There is no disclosure relevant to the conversion of liquid products.

The process produces mainly hydrogen with some methane and acetylene. Reaction products may be recycled through a passage in the cathode. There is no disclosure of feeding in a gas which does not consist mainly of hydrogen or of injecting coal particles in finely divided form into the arc. The coal particles are fed into the arc as a layer by means of a screw conveyor.

German Pat. No. DE-A-26 39 807 discloses a hydrocarbon conversion process using an electric arc within a distillation column. Lubricating oil is treated with a gas containing hydrogen to give products of lower boiling point. The specification states that the energy of the arc causes splitting of molecular hydrogen into active hydrogen and of hydrocarbons to radicals which then combine in the vicinity of the arc to form new hydrogen rich compounds. No details are given of the construction of the apparatus nor is anything said which suggests that the manner of introducing the hydrocarbon and the hydrogen into the arc is important.

DE No. 369 367 again discloses the reaction of hydrocarbons and hydrogen in a electric arc. The arc is maintained under water and no details are given of the manner of operating the process.

CH No. 132 904 discloses the combination of hydrogen with hydrocarbons by splitting of hydrogen into atomic hydrogen in an electric arc. The hydrocarbon is passed together with hydrogen into the arc. The preferred process is a discontinuous process in which hydrogen is first introduced and dissociated and then hydrocarbon vapour is introduced. Such a discontinuous process is not commercially practical.

The conventional treatment of crude petroleum uses various different conversion processes enabling light hydrocarbons such as fuel oil, gas oil and gasoline to be obtained. In each process a distinction can be made between those which utilise the action of temperature (thermal processes) such as thermal reforming, thermal cracking, and steam cracking, and catalytic processes such as catalytic cracking which can be carried out in a fluidised bed or hydrocracking carried out in the presence of hydrogen.

All these currently used processes do not allow high conversions to light saturated hydrocarbons, liquid at ambient temperature, to be obtained directly. They give rise to heavy residues often with a high metal content. They are not adapted to treating products very rich in carbon such as coal or heavy petroleum residues.

Furthermore, catalytic processes are very sensitive to impurities such as metals, sulphur or nitrogen and require significant purification or hydrocracking treatments or require complex operations of regenerating the catalyst and/or burning of coke in fluidised bed catalytic cracking apparatus.

According to the process of the present invention the process for the electric arc conversion of carbonaceous materials to lower molecular weight products is characterised in that a feed containing a substantial proportion of a $C_1$–$C_4$ saturated hydrocarbon is brought into contact with an electric arc and a feed containing a higher molecular weight carbonaceous material is brought into contact with hot gas derived from the $C_1$–$C_4$ hydrocarbon in the vicinity of the electric arc.

The process of the present invention presents the advantage by comparison with catalytic cracking of not requiring very narrow hydrocarbon fractions and of not being adversely affected by the presence of sulphur for the latter is transformed, under the reaction of hydrogen, into $H_2S$ which is easy to eliminate. The presence of nitrogen also does not adversely affect the process according to the invention.

$C_1$–$C_4$ saturated hydrocarbon is believed to act as a source of hydrogen. Preferably the hydrocarbon is methane or ethane. Mixtures of $C_1$–$C_4$ saturated hydrocarbons may be used. Hydrogen from an external source may also be present. The presence of small amount of hydrogen increases the life of the electrodes, in particular the cathode (when using direct current arcs). The hydrogen is preferably injected into a laminar zone at the hot foot of the cathode. However the presence of a substantial proportional hydrogen will increase costs.

The $C_1$–$C_4$ therefore preferably forms a substantial proportion of the feed in which it is introduced into contact with the arc, ie at least 40% by volume, preferably at least 60% by volume, more preferably 90% by volume.

Water vapour may also be present, but it is then desirable to eliminate subsequently an CO and $CO_2$ formed to avoid corrosion.

The higher molecular weights carbonaceous material which is converted into lower molecular weight products will hereinafter be referred to as the carbonaceous feedstock and may be hydrocarbon material derived from petroleum. It may for example contain hydrocarbons having more than 10 carbon atoms in the molecule. Examples of feedstocks which may be used are gas-oil fractions as well as fractions containing essentially more than 20 carbon atoms in the molecule and heavier than gas oil such as those which can be obtained from "atmospheric residue" and "vacuum residue". Such fractions may have an average about 36 atoms of carbon in the molecule. The process may also be applied to solid carbonaceous material eg coal.

It will generally be desirable to pre-heat the carbonaceous feed before it comes into contact with the arc. Preferably the feed is pre-heated to a temperature between 380 ° and 430° C. and preferably about 400° C. If the temperature of the carbonaceous feed is too low the products are too cold when they leave the electric arc. It would be necessary in this case to increase the temperature of the arc which would risk increasing the formation of undesirable acetylene and coke. The preheating temperature for the carbonaceous feed should not exceed 430° C. in order to avoid the beginning of the significant thermal cracking in the furnace favouring the formation of poly aromatic compounds which subsequently risk being transformed into graphite or into coke.

It is known that visco reduction, a purely thermal operation, is limited to 15% in practice and that difficult problems linked to the formation of coke appear in the preheating furnace.

As a result it is advantageous to remain at the lower limit of natural cracking to avoid the problems linked to the formation of coke in the furnace and the beginning of the formation of polyaromatic compounds. Furthermore, by introducing carbonaceous feed into the reaction at a relative low temperature, it is possible to recover the thermal energy of the products of the arc by a quenching step for these products and of thermal shock for the heavy hydrocarbons.

The higher molecular weight carbonaceous material is preferably injected in finely divided form into a gas phase surrounding the arc.

The $C_1$–$C_4$ saturated hydrocarbon is preferably introduced into the arc so as to cause a gas stream to flow parallel to the arc and the higher molecular weight carbonaceous material is brought into contact with the arc downstream (in relation to the gas flow) from wherein the $C_1$–$C_4$ hydrocarbon is brought into contact with the arc.

The arc is preferably established between two axially extending electrodes and the $C_1$–$C_4$ saturated hydrocarbon is brought into contact with the arc in the vicinity of one electrode and the higher molecular weight carbonaceous material is brought into contact with the arc in the vicinity of the other electrode.

The process may be carried out using an alternating current arc, but preferably uses a direct arc.

When using a direct current arc the $C_1$–$C_4$ hydrocarbon is preferably brought into contact with the arc in the vicinity of the cathode.

The following description is based on the preferred process using a direct current arc with the $C_1$–$C_4$ hydrocarbon brought into contract with the arc in the vicinity of the cathode, but in for example alternating current arcs references to cathode and anode arc to be understood as referred to upstream and downstream electrodes (in relation to the direction of gas flow).

The hydrogen-generating gas mixture is introduced at the foot of a hot cathode arc (of the tungsten type) maintained at elevated temperature by ionic bombardment and controlled at the optimum temperature by cooling.

The $C_1$–$C_4$ hydrocarbon vapour is introduced under controlled pressure to blow the arc and to generate an arc having speed between 50 and 600 and preferably 100 m/s, the speed being a function of the nature of the $C_1$–$C_4$ hydrocarbon containing gas.

This speed is obtained in a conventional expansion nozzle, thermally protected by the gas which flows through it and by water cooling.

The electric potentials of the arc increase from the cathode to the anode and the electric currents which pass through the arc rapidly raise the temperature of the whole of the gas in movement up to 1400°–1600° C., in a few centimetres for a low tension arc of the order of 200 volts. Under the combined action of temperature of the electronic bombardment, the conversion of the hydrogen-generating as mixture accelerates to be substantially terminated on arriving at the anode or before the anode. The temperature of the gas in the arc is preferably controlled so as not in general exceed 1800° C. in order to minimise the formation of excessive acetylene and to avoid soot formation. The feed rates and speeds of the gas are controlled in order to allow control of the average energy applied to each starting molecule. Thus if the temperature of the neutral materials exceeds 1800° C. it is necessary that the contact of the particles with the zone where the temperature exceeds 1800° C. is very short of the order of a fraction of a second.

There is thus produced at the foot of the anode a mixture at elevated temperature rich in hydrogen and in various radicals.

The carbonaceous feed is preferably fed to the anode or the vicinity of the anode by means of injectors with mechanical atomisation or with an atomiser assisted by injection of light gas preferably butane or propane which then participates in polymerisation reactions with $CH_2$ radicals. Vapour assisted atomisation minimises undesirable graphitic deposits at the foot of the arc.

This injection of gas equally serves to separate the hot gas from the anode and to cause it to rise above the anode.

The injection is preferably carried out under a pressure of the order of 10 bars in order to obtain very fine atomised jets with high kinetic energy containing droplets having a diameter between a few microns and a few tenths of millimetres, in such a way that the evaporation time is of the order of the life of the radicals leaving the arc and derived from the $C_1$–$C_4$ saturated hydrocarbon and that the diffusion time corresponds to the recombination time with the other radicals. This useful life is of the order of 1/100s under the conditions used. The injection should be carried out within short distances. The injection breaks the jet of the arc and of the post arc, either on the anode itself, or towards the rear of the anode, or on baffles which allows an effective introduction of the heavy atomised products which after depressurisation, are partly in the liquid phase and partly in the vapour phase.

It may be desirable to arrange the injectors so that material introduced through the injectors has an elongated path exposed to UV radiation from the arc before arriving in the vicinity of the arc.

In order to favour mixing and turbulence, the injection of the carbonaceous feed is advantageously made in the opposite direction to the direction of movement of the gas in the electric arc, by means of injectors placed at the end of the anode, for high powers. According to another embodiment, a cylindrical hollow anode surrounding the end of the electric arc comprises means for the injection of heavy hydrocarbons at the limit of vaporisation into the axis of the electric arc and in the opposite direction to the latter. This arrangement has the advantage of reducing the erosion of the anode and of favouring the internal mixture of the products.

It has been realised that in certain conditions the carbonaceous feed passing close to the arc or in very hot zones crack and create graphitic conducting growths which can be chemically eroded by controlled oxidation. This makes possible graphite electrodes which are almost non-consumable.

In order to increase the efficacy of the process the residence time of the carbonaceous feed at the foot of the anode is increased and as a result the contact with the ions, the injection of carbonaceous feeds being made preferably tangentially or obliquely. The increase of turbulence can be obtained also by causing the rotation of the electric arc by various means, particularly magnetic means, also by pneumatic means. This rotation is preferably carried out in the inverse direction to the movement of the carbonaceous feed injected tangentially.

The injection of the carbonaceous feed is carried out at such a rate that the maximum increase in temperature of the droplets, liberating gas, does not exceed 800° C. and which avoids an excessive residence time above 600°-700° C. Temperatures of the order of 600° C. are preferred.

Very heavy aromatic residues can be treated in the reactor at a more elevated temperature and introduced a vortex surrounding the arc by striking the temperature controlled zone at the foot of the arc at the anode, in such a way as to crack them and to hydrogenate them violently. Nevertheless this leads to a higher consumption of hydrogen.

The first generation products, rich in naphthenics or paraffins may be introduced into a thermal quench at the exit of the arc for they are easier to crack.

The carbonaceous feed receives during the beginning of its movement towards the foot of the anode radiation from the arc rich in ultra-violet radiation favourable to pre-activation then arrives at the lower part of the arc where it collides with the hot gases. The carbonaceous feed is then rapidly cracked in a limited way, into several fragments, preferably 2 to 4, by the choice of operating energy conditions above mentioned. Coal suffers a flash pyrolysis.

It is very desirable to create a high speed gas barrier between the arc and the liquid globules, in such a manner as to avoid the formation of a coke chimney surrounding the arc.

These heavy radicals, more or less hot and not in thermal equilibrium with the surrounding environment, collide with $CH_2$ and ethylenic radicals. Useful polymerisation takes place or during the collisions with hydrogen which cause hydrogenation leading to middle range $C_4$-$C_{18}$ saturated hydrocarbons. These reactions take place in a temperature range of 450°-850° C. and preferably towards a temperature of the heavy products between 600° and 700° C. advantageously between 600° and 650° C.

At the end of the reaction when thermal equilibrium is approached and optionally after injection of heavy products in the form of a quench, the products pass into a reaction zone between 550° and 450° C. which favours polymerisation reactions of light hydrocarbons between themselves with hydrogenation in the beginning of addition of olefinic hydrocarbons to the saturated hydrocarbons giving the medium saturated hydrocarbons.

Other reactions than those mentioned above may equally take place. Indeed the reactions which take place in the reactor ae extremely complex and closely interdependent. They are all controlled by the dynamic viscosity of the products in turbulent flow both in liquid and in gaseous phase, the heavy products being injected into the reaction at the limit of equilibrium between these two phases. It is appropriate to choose a dynamic viscosity as low as possible in acting on the temperature. Further, atomisation allows a good surface of contact between the different products and species taking part in the reaction.

Another important point of the process according to the invention concerns the energies put into operation.

The functioning of the reactor according to the invention is such that the average energy supplied to the molecules between the energy of rupture of the H-C bonds and C-C bonds (between 4.3 and 3.7 ev) and the dielectric breakdown (0.1-0.3 ev). Thanks to the low level of ionisation obtained in the electric arc by a relatively low electron density, the energy necessary to carry out the reaction remains low. It is of the order of 1.5-5 and preferably from 2-3 ev (electron volts) per molecule in the arc, above this level soot is generated.

The low level of ionisation is a level below 5% and is preferably of the order of one part per thousand. This favours the formation of neutral compounds and radicals as well as the formation of nascent hydrogen instead of ionised compounds.

The electric arc is used to reduce the activation energy of the chemical reactions in a weakly ionised medium, favourable to the creation of active neutral species, which requires the control of the contact time of the order of a hundreth to one thousandth of a second. The electric arc is preferably fed by continuous current in order to facilitate control and stability which is improved by a large smoothing self inductance creating a stabilising counter electro motive force opposing variations in the current. With alternating current this self inductance is necessary in order to define the current and to stabilise the characteristics of negative arcs.

The anode is made from a conventional metal cooled with water or from a refractory material of the molybdenum, tungsten, or tungsten carbide type, or is composite. In order to increase the intensity of the arc and the life of the anode, the latter is advantageously composite that is to say it consists of a first material resistant to heat, a good conductor of electricity with a high melting point and low vapour pressure and having preferably a good secondary thermal ionic emission, surrounded by a second material, hereinafter called "binder" which is a very good conductor of heat and electricity, has a low vapour pressure, and is very dense and heavy. Composite anodes in thoriated tungsten within a copper binder are preferred. According to a simple way of carrying out the reaction, for low powers, for example 200-600 amperes, the anode consists of a bar of thoriated tungsten, with 2% thorium, in a copper binder.

According to another embodiment, several thinner wires or rods of thoriated tungsten are surrounded by a copper binder.

According to another variant the anode can consist of a hollow conductor containing a molten metal (iron, cast iron or copper). For high powers it is desirable to increase the resistance of the anode to heat. In this case the technique called "transpiration" can advantageously be used. This technique consists in vapourising a liquid (which can be water or the hydrocarbon itself) at the surface of the anode of which has the consequences of cooling the anode and covering it with a cold film. Alternatively, a cold gas may be passed to the surface of the anode.

For carrying out this technique of transpiration it is advantageous to use a porous sintered anode, for example sintered tungsten, bound with a suitable binder which can be copper, cobalt or a similar metal which will allow the cooling liquid or gas to pass. A variant of the anode usable for the transpiration technique can be a composite thoriated tungsten/copper anode in which the copper part is pierced with holes.

The purpose of the anode is to extract the highly mobile electrons in the arc, electrons which have been ejected from the cathode by the thermo electronic effect, then under the influence of the electric field have bombarded along their passage through the arc molecules, atoms or radicals which were in their path and which barred their route, either by destroying them or by transmitting energy by shock.

The length of the arc is a function of the applied voltage and of the pressure. The speed of the gas is also limited by the voltage and the intensity of the arc.

The speed of the expanded gas leaving from the nozzle imposes on the ions a determined trajectory, thanks to their kinetic energy and their inertia which provides a remarkable stability to the arc.

This has the advantage of suppressing the necessity to have recourse to complex stabilisation devices, in particular magnetic devices, which would have to be placed in the zone of injection of the heavy products already fairly encumbered.

The ratio arc length: speed determines the total reaction time of conversion of the hydrogen-generating gas mixture into useful product, in particular atomic or molecular hydrogen; this time is of the order of a millisecond. It is adjusted according to the atomisation criteria indicated.

The section of the nozzle which determines the feed rate of the hydrogen-generating gas mixture also determines the electric power for the nominal feed rate.

The controls comprise:

action on the level of release in the nozzle to regulate the feed rate, action on the speed of the arc to control the reaction times.

By way of example with reactors of low power (80 A, 150 V) one will work with an arc of 7 to 10 cm with feed rates of the order of 0.25 kmoles/h of light gas. The fall in cathode voltage is of the order of 30 V and the fall in anode voltage about 20 V, with a field of the order of 10 V/cm. Long arcs allow the electric yield to be increased.

As indicated above the heavy hydrocarbons can be replaced by coal powder, not in order to make acetylene, which is known but in order to recover the lighter constituents contained in the coal by liquifying the latter after a pseudo pyrolysis and hydrogenation. In this case, the coal is introduced in finely divided form in place of the heavy hydrocarbons or is dispersed in a liquid phase with the hydrocarbon.

The residence time in the reaction is in the order of a second to several seconds and depends on the level of conversion, that is to say the relative feed rate of the heavy products introduced in relation to the hydrogen-generating gas mixture.

The products are then sent to a distillation unit (atmospheric or lightly pressurised). Following the distillation gas oil, heavy gasoline and light products are obtained which in their turn are separated into light gasoline and to $C_1$–$C_4$ gaseous hydrocarbons. The latter are returned to the expansion nozzle in order to be mixed with the $C_1$–$C_4$ saturated hydrocarbons. The heavy products of atmospheric residue type having more than 18 atoms of carbon per molecule are recycled with the carbonaceous feed used as starting materials.

The latter may be constituted from residues resulting from the distillation at atmospheric pressure of crude petroleum with generally high cut points, of from vacuum residues, these may be hot materials coming directly from the vacuum distillation or mixtures of such distillates or may be cold materials. As indicated above the coal charges are preheated, before their introduction into the reactor in a furnace which raises them to a temperature of 380°–430° C., preferably to about 400° C.

According to a further aspect of the present invention, an electric arc reactor suitable for conversion of carbonaceous feeds to lower molecular weight products comprises.

(a) an elongated reaction chamber, (b) a first electrode disposed adjacent one end of the chamber (c) a second electrode axially spaced from the first electode so as to be capable of giving an axially extending arc between them, (d) means for introducing gas into the chamber in the vicinity of the first electrode so as to cause a gas flow along the chamber, (e) means for injecting finely divided material into the chamber so arranged that injected material will strike the arc in the vicinity of the second electrode, (f) a mixing zone downstream from the second electrode, (g) means for removing products from the chamber downstream from the mixing zone.

The invention is illustrated by the drawings.

Figure 1:
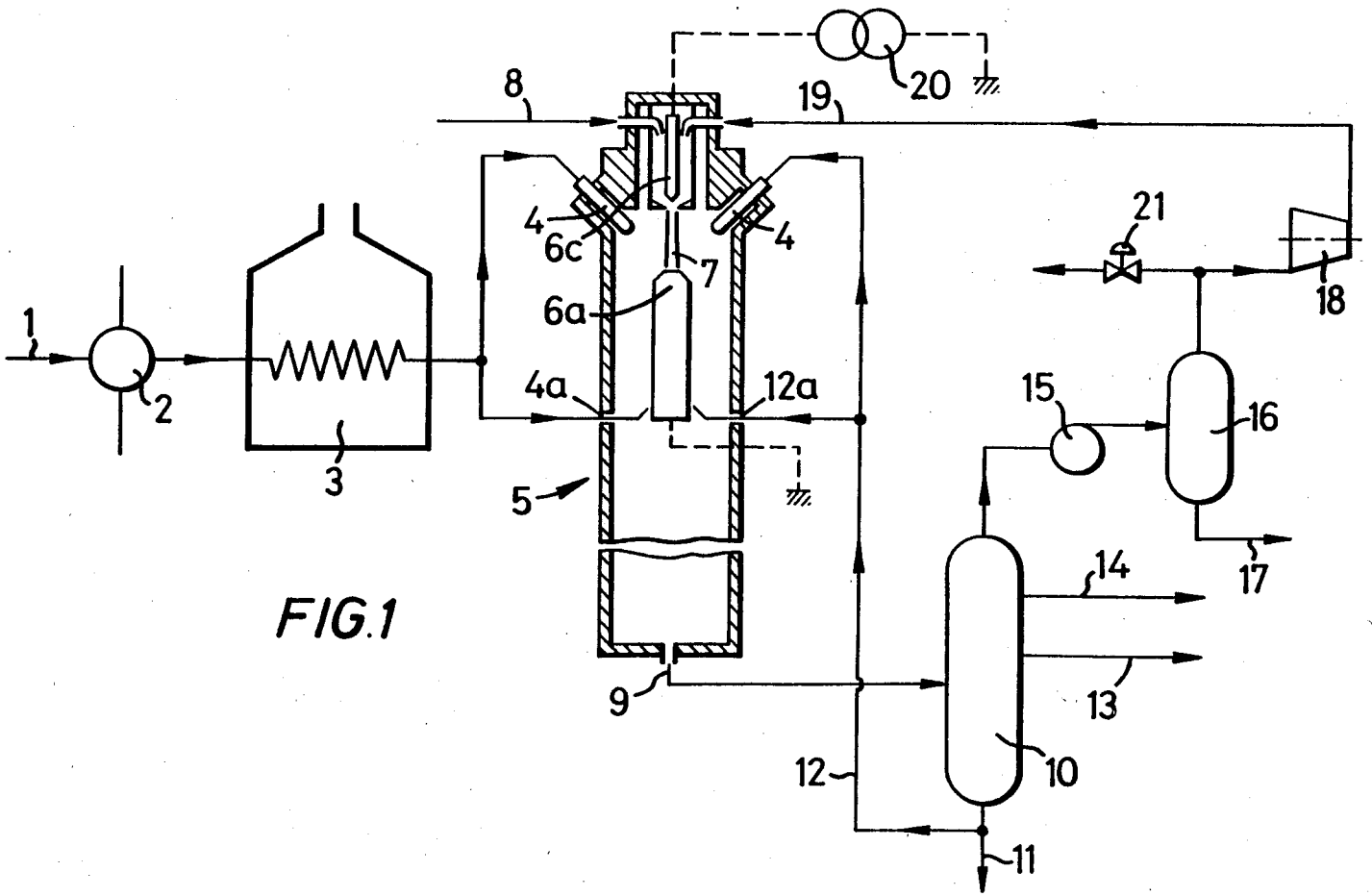
FIG. 1 represents a schematic diagram of the conversion installation.

Referring to FIG. 1 the carbonaceous feed arrives by pipe 1 passing by heat exchanger 2 and then by thermal furnace 3 from which they leave at a temperature between 380° and 430° C. They arrive at injectors 4 where they are injected into reactor 5 equiped with a cathode 6*c* and an anode 6*a* between which electric arc 7 is formed. The $C_1$–$C_4$ saturated hydrocarbon is introduced by nozzle 8.

According to one variant a part of the carbonaceous feed leaving the thermal furnace 3, and preferably in the vapour phase, is directed by 4*a* towards the base of the anode from which it rises along the length of the latter to separate the hot gas coming from the cathode in order to diminish the erosion of the anode and to assure efficient mixing.

After conversion, the products leave by pipe 9 which leads them into a distillation apparatus 10 operated at atmospheric or slightly superatmospheric pressures from which the distillation residue is removed by pipe 11 and heavy hydrocarbons having more than 18 atoms per carbon are recycled by pipe 12 to inject as 4.

According to one variant a part of the heavy recycled hydrocarbons is led by pipe 12*a* towards the base of the anode and rises along the latter contributing to separating the hot gases coming from the cathode.

The distillation apparatus 10 (distillation tower of atmospheric type) separates the gas oil which passes by pipe 13 and the heavy gasoline which passes by pipe 14. The lighter products are extracted by pump 15 and led into the pressure distillation apparatus 16 where they are separated into light gasoline which passes by pipe 17 and a gaseous product which is compressed in a compressor 18 and recycled by pipe 19 to nozzles 8. The electric supply to the reactor is represented by generator 20. A purge 21 allow the apparatus 16 to be purged.

Figure 2:
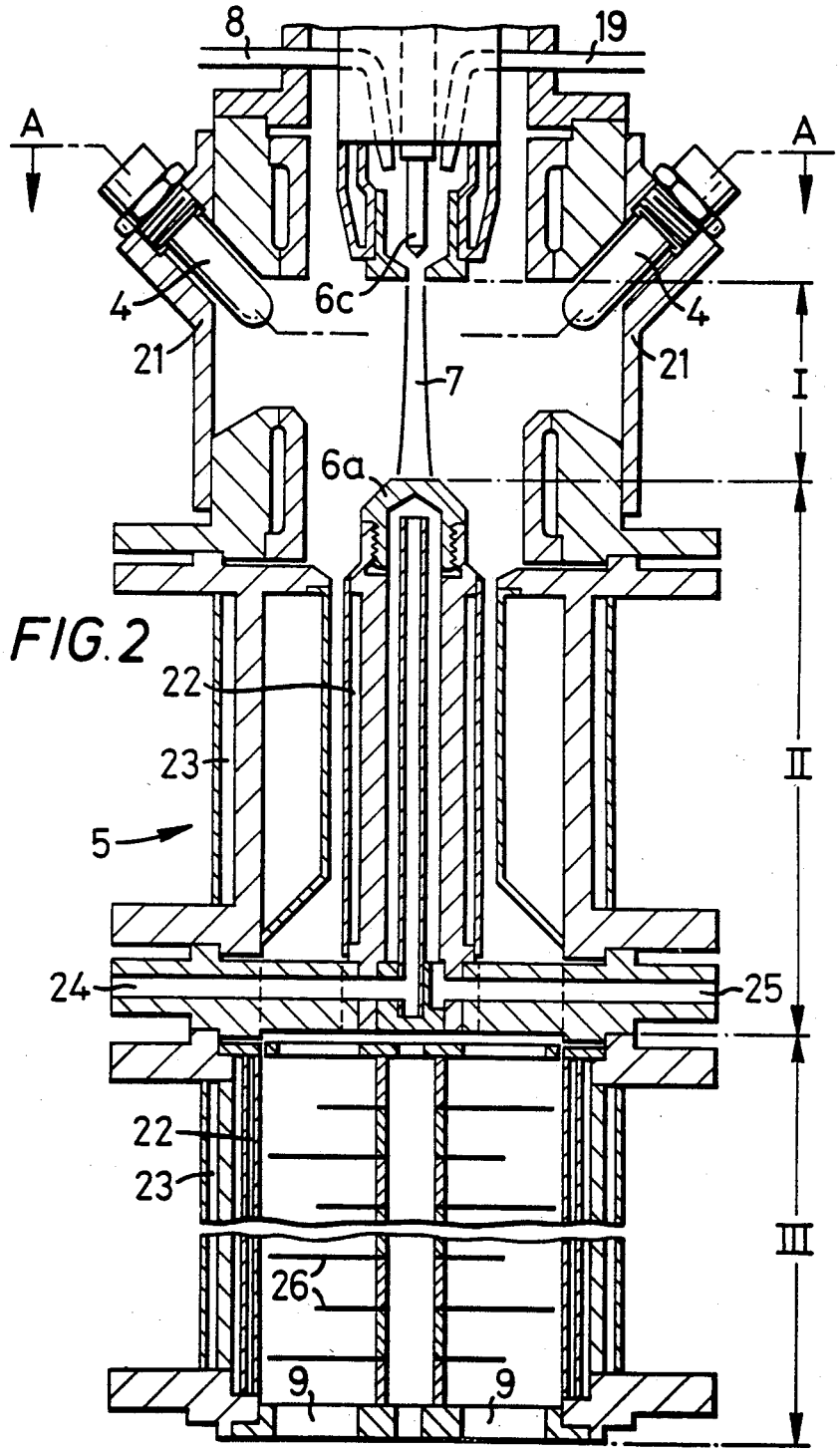
FIG. 2 represents a vertical axial section of the electric reactor.

FIG. 2 shows the arrangement of the electrically assisted reactor 5 which comprises:

(a) a first zone I at high temperature comprising a cathode 6*c* and an anode 6*a* defining a substantially cylindrical and axial electric arc 7, means for introducing the carbonaceous feed (injectors) 4 placed in injector supports 21 and the means for introducing a hydrogen generating gas mixture (nozzle 8);

(b) a second reaction zone II of very rapid elements very far from equilibrium, at intermediate temperature, where there takes place; the mixing of heavy carbonaceous products to be cracked arriving at a temperature of about 430° C. and of light hot products rich in hydrogen; the sudden heating of the heavy carbonaceous products and the controlled cracking of the heavy hydrocarbons, an endothermic operation, the use of the radicals leaving the arc at the beginning of hydrogenation and polymerisation;

(c) a third zone III of maturation and quasithermal evolution according to slower reactions; in this zone of lower temperature there takes place the reaction of light olefinic hydrocarbons with the saturated light hydrocarbons and the end of the hydrogenation leading to the middle range saturated hydrocarbon.

Zones II and III are thermally insulated by immobile gas imprisoned in tubes intended to reduce conduction and by a ring of small diameter in porous insulating material such as alumina, silica, zirconia in order to absorb the radiation (in particular infra red radiation).

These zones are also cooled by circulation of a refrigerating liquid, preferably water 23. The refrigerating liquid enters at 24 and leaves at 25.

Figure 3:
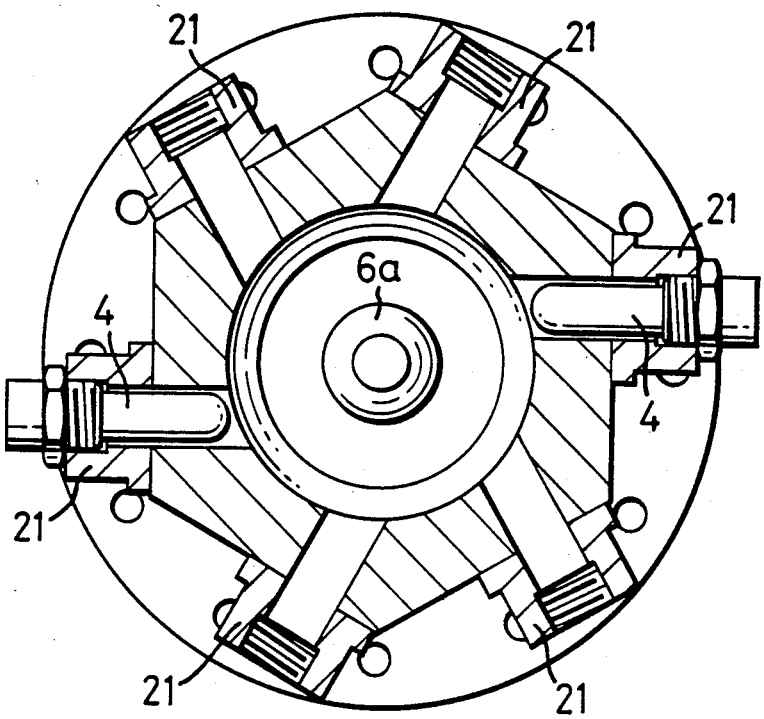
FIG. 3 represents a section through A—A of the electric reactor.

FIG. 3 shows a section of the reactor 5 which according to an advantageous embodiment comprises six injector carriers 21 equiped with injectors 4 (of which only two are shown) which assure the tangential injection of the heavy carbonaceous product.

The lower part of the reactor can be provided with baffles 26 intended to homogenise the products during the residence of the gas in zone III of the reactor.

The temperatures decrease from above to below in the reactor. In upper zone I the temperature is below 1800° C. and above 850° C. In the middle part of the reactor which forms zone II, the temperature, very heterogeneous at the level of the molecules and droplets, is 450°–850° C. and preferably 550°–850° C. In the lower part which forms zone III, the temperature is 350°–550° C. and preferably 450°–550° C.

The lower part of zone II, and III can be maintained if desired at lower temperatures by injection of heavy carbonaceous products in the form of quench or by recycling $C_3$ and $C_4$ hydrocarbons or gasoline, in conditions favourable to addition reactions and/or polymerisation.

In zone I there is formation of hydrogen, light radicals, and ethylene deriving from the $C_1$–$C_4$ aliphatic hydrocarbon vapour, and which takes part in the hydrogenation reactions in zone II and polymerisation reactions in zone III.

The different reactions taking place in the three zones I, II and III are complex.

Polymerisation can if desired take place in a furnace or secondary reactor located at the exit of the electric arc reactor.

The means of producing the $C_1$–$C_4$ saturated hydrocarbon vapour is advantageously an expansion nozzle (level about 1,1) capable of introducing the hydrogen-generating gas mixture into the vicinity of the end of the cathode and effecting a partial blowing of the electric arc.

Several injectors, preferably 6, are disposed at the periphery of the third zone in inclined and tangential directions in order that the injected products (heavy hydrocarbons or coal) can reach the zone of the arc in the vicinity of the anode. The inclination of the injectors can be modified and the injectors may be given different inclinations for the injection of heavy carbonaceous products of different natures.

The lower zone (Zone III) of the reactor is advantageously provided with baffles allowing the prolongation of the residence time of the products in the reactor.

The anode, zones II and III are advantageously insulated thermally by stationary gas imprisoned in tubes as well as by a thin layer of refractory particulate porous material such as alumina silica zirconia intended to absorb radiation.

Zones II and III are in addition cooled by circulation of a liquid refrigerant. This liquid refrigerant is preferably water in order to be able to use less expensive material (steel or carbon). The invention equally has for its object a conversion apparatus comprising in addition to the electric arc reactor a preheating furnace for the heavy carbonaceous feed located upstream from the reactor, optionally a polymerisation furnace downstream from the reactor, means for introducing a carbonaceous feed in the form of a liquid into the reactor immediately downstream of the second zone to carry out a quench; means for distilling under atmospheric or slightly super atmospheric pressures products obtained from the reactor to separate them into gas-oil, heavy gasoline, light gasoline and gaseous products; means for distilling light products under pressure to separate them into light gas and gaseous products; means for recycling to the injectors the excessively heavy products derived from the atmospheric distillation, and means for recycling light gases to the feed nozzles. By way of example apparatus capable of treating 237 tonnes/hour of atmospheric residue would require a battery of six reactor of 10 to 15 MW, would consume 18t/h of natural gas and would convert 85% of the atmospheric residue into gas-oil (47%) and into gasolines (33%) with a limited production of gas rich in hydrocarbons having 3 and 4 carbon atoms, these gas being recycled. The thermal consumption of the furnace for preheating the coal feed would be of the order of 4.7t/h.

The invention will now be further illustrated with reference to the following examples.

In all these examples direct current arcs were used with electrode **6*a*** as the cathode.

EXAMPLE 1

Figure 4:
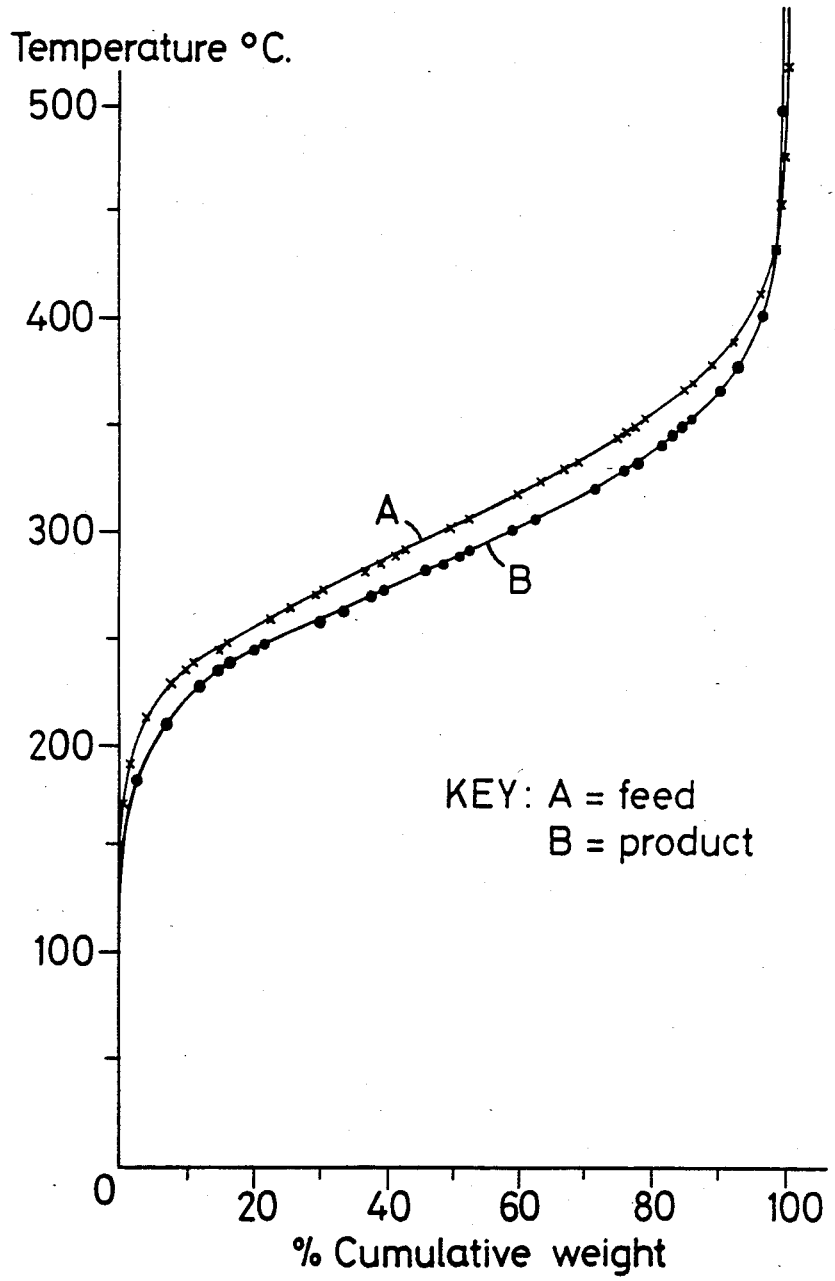

This shows the hydrotreatment of light gas oil at a low conversion rate. The feedstock instroduced through injectors 4 in the apparatus of FIG. 1 was a light gas oil with a hydrogen to carbon ratio of 1.813:1. The TBP curve is given in FIG. 4. The hydrogen-generating gas was methane. Argon was used as a diluent. The process was operated without recycle of products.

The operating conditions were:

Feed injection pressure: 10 bars

Methane flow rate: 3.33 kg/h (measured at normal temperature and pressure)

Gas oil flow rate: 14.4 kg/h

Intensity of Arc: 120 amps

Arc·length: 3.5 cm

The products obtained were:

| Gases | % mol |
|---|---|
| $H_2$ | 14.06 |
| $CH_4$ | 82 |

-continued

| Gases | % mol |
|---|---|
| $C_2H_2$ | 1.77 |
| $C_2H_4$ | 0.65 |
| $C_2H_6$ | 1.28 |
| $C_3^+$ | 0.24 |

Liquid

Light Gas Oil with a total boiling point curve below that of the feed gas oil.

The methane fixation based on liquid feedstock was 44% wt.

The gas absorption balance is calculated as:

$$\frac{CH_4\text{ (feed)} - \text{Gas products (including } CH_4)}{CH_4\text{ (feed)} - CH_4\text{ (exit)}} = 53\%\text{ wt}$$

EXAMPLE 2

This shows the influence of temperature in the mixing zone (zone II) and soaking zone (zone III).

The feedstock injected through injectors 4 was slack wax ($C_{22}$–$C_{42}$) cut point 440°–540° C.

The hydrogen-generating gas was a mixture of $CH_4$ and $H_2$.

The rates of feed and arc conditions were as in Example 1 [?]. The slack wax was pre-heated to 430° C. The temperature of zone II was 850° C., and of zone III was 575° C.

The products obtained were:

| | % mol | | |
|---|---|---|---|
| Gases | | | |
| $H_2$ | 50 | | |
| $CH_4$ | 28 | | |
| $C_2H_2$ | 2 | | |
| $C_2H_4$ | 6.7 | | |
| $C_2H_6$ | 4.7 | Total $C_2$ | 13.4% mol |
| $C_3H_6$ | 5.2 | | |
| $C_3H_8$ | 1.6 | Total $C_3$ | 6.8% mol |
| $C_4H_6$ | 0.2 | | |
| $C_4H_8$ | 1.3 | | |
| $C_4H_{10}$ | 0.3 | Total $C_4$ | 1.8% mol |
| Liquids | | | |
| $C_5$–$C_9$ | 19 | | |
| $C_{10}$–$C_{13}$ | 20 | | |
| $C_{14}$–$C_{21}$ | 23 | | |
| $C_{22}$+ | 38 | | |

Experiments were carried out above with zone III maintained at different temperatures and the percentage conversion into products having less than 21 carbon atoms in the molecule determined.

Figure 5:
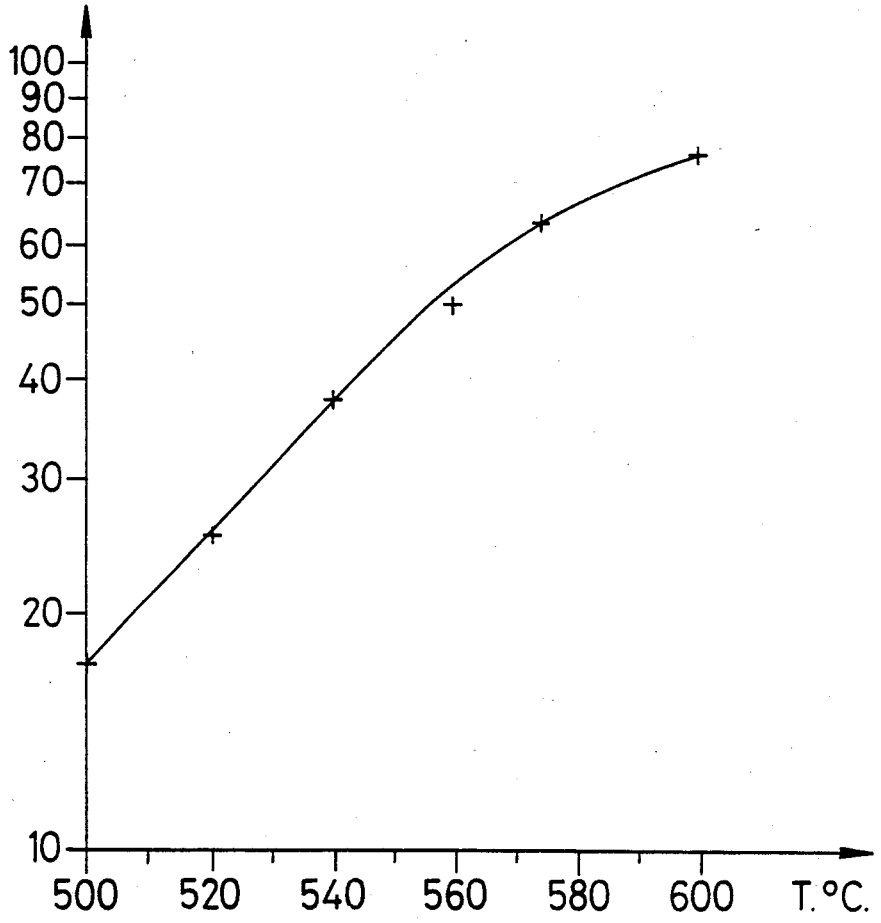

The results are shown in FIG. 5.

EXAMPLE 3

This example shows the total gasification of heavy hydrocarbons.

The feedstock injected through injectors 4 were $C_{12}$–$C_{16}$ n-paraffins.

The hydrogen-generating gas was a mixture of methane and hydrogen.

The operating conditions were:

Feed injection pressure: 10 bars

Methane flow rate: 4 $m^3/h$ (normal temperature and pressure)

Hydrogen flow rate: 2 $m^3/h$ (normal temperature and pressure)

n-Paraffins: 20 kg/h

Arc intensity: 200 amps

Arc length: 7 cm

The process was operated without recycle:

Products

Liquids: nil

Solids: soot formation owing to high conversion conditions

Gas: 30.3 $m^3/h$ (normal temperature and pressure)

| Gas composition | % mol |
|---|---|
| $H_2$ | 59.1 |
| $CH_4$ | 23.1 |
| $C_2H_2$ | 6.4 |
| $C_2H_4$ | 6.7 |
| $C_2H_6$ | 0.4 |
| $C_3H_8$ | 3.2 |
| $C_4H_{10}$ | 0.9 |
| $C_5H_{12}$ | 0.2 |

These examples demonstrate the flexibility of the process.

We claim:

1. A process for the electric arc conversion of high molecular weight carbonaceous material contained in a feed stream to low molecular weight products characterized in that a hydrocarbon feed stream containing a substantial proportion of $C_1$–$C_4$ saturated hydrocarbon and a feed stream containing high molecular weight carbonaceous materials are brought into contact with an electric arc, said feed stream containing said high molecular weight carbonaceous material being brought into contact, in the vicinity of the arc, with a hot gas stream derived from the said hydrocarbon feed stream containing $C_1$–$C_4$ saturated hydrocarbon.

2. A process according to claim 1 wherein the $C_1$–$C_4$ saturated hydrocarbon is methane.

3. A process according to claim 1 wherein the higher molecular weight carbonaceous material comprises hydrocarbons having more than 10 carbon atoms in the molecule.

4. A process according to claim 1 wherein the higher molecular weight carbonaceous material comprises coal.

5. A process according to claim 1 wherein the higher molecular weight carbonaceous material is injected in finely divided form dispersed into a gas phase surrounding the arc.

6. A process according to claim 5 wherein the $C_1$–$C_4$ saturated hydrocarbon is introduced into the arc so as to cause a gas stream to flow parallel to the arc and the higher molecular weight carbonaceous material is brought into contact with the arc downstream (in relation to the gas flow) from where the $C_1$–$C_4$ hydrocarbon is brought into contact with the arc.

7. A process according to claim 6 wherein the arc is established between two axially extending electrodes disposed on a common axis and the $C_1$–$C_4$ saturated hydrocarbon is brought into contact with the arc in the vicinity of one electrode and the higher molecular weight carbonaceous material is brought into contact with the arc in the vicinity of the other electrode.

8. A process according to claim 7 wherein the arc is a direct current arc and the $C_1$–$C_4$ saturated hydrocarbon is brought into contact with the arc in the vicinity of the cathode.

9. A process according to claim 1, characterised by the fact that the higher molecular weight carbonaceous material is pre-heated to a temperature of between 380° and 430° C., and is then injected under pressure in finely atomised form, the diameter of the droplets of particles varying from a few microns to a tenths of millimetres.

10. A process according to claim 5 characterised by the fact that the carbonaceous feed is injected obliquely at an angle inclined in relation to the direction of the arc and tangentially in relation to the latter.

11. A process according to claim 1 characterised by the fact that at the exit of the reactor, the resulting mixture is submitted to one or more distillations separating gas oils and gasolines from heavy products having more than 18 atoms of carbon, and from residues and light gaseous hydrocarbons, which the latter are totally or partially recycled with a hydrogen of generating gas mixture and that the hydrocarbons having more than 18 carbon of atoms are recycled with the heavy carbonaceous products serving of feedstocks.

* * * * *